US009409626B2

(12) United States Patent
Sliwinski

(10) Patent No.: US 9,409,626 B2
(45) Date of Patent: Aug. 9, 2016

(54) FLOATING UNIT

(71) Applicant: Wojskowy Instytut Techniki Inzynieryjnej im. profesora Jozefa Kosackiego, Wroclaw (PL)

(72) Inventor: Janusz Sliwinski, Wroclaw (PL)

(73) Assignee: WOJSKOWY INSTYTUT TECHNIKI INZYNIERYJNEJ, Wroclaw (PL)

( * ) Notice: Subject to any disclaimer, the term of this patent is extended or adjusted under 35 U.S.C. 154(b) by 0 days.

(21) Appl. No.: 14/720,996

(22) Filed: May 26, 2015

(65) Prior Publication Data

US 2016/0075407 A1 Mar. 17, 2016

(30) Foreign Application Priority Data

Jun. 18, 2014 (PL) ..... 408600

(51) Int. Cl.

| | |
|---|---|
| ***B63B 1/38*** | (2006.01) |
| ***B63B 3/10*** | (2006.01) |
| ***B63C 11/44*** | (2006.01) |
| *B63B 35/00* | (2006.01) |

(52) U.S. Cl.

CPC . *B63B 3/10* (2013.01); *B63C 11/44* (2013.01); *B63B 2035/001* (2013.01)

(58) Field of Classification Search

CPC ..... B63B 3/00; B63B 3/10; B63B 2003/00; B63B 11/00; B63B 11/02

USPC ..... 114/1, 9–15

See application file for complete search history.

(56) References Cited

U.S. PATENT DOCUMENTS 2,071,802 A * 2/1937 Sweeley ..... B61D 45/006 410/132

4,478,165 A * 10/1984 Strain ..... B63B 11/04 114/74 R

* cited by examiner

*Primary Examiner* — Daniel V Venne

(74) *Attorney, Agent, or Firm* — Mark M. Friedman

(57) ABSTRACT

A floating unit comprising: a hull having a recess in which a deployable wall is mounted, the wall being movable between a first and a second position; wherein in the first position the wall is enclosed within the hull in the recess; and in the second position the wall at least partly protrudes from the hull, thereby defining a partly enclosed space; and wherein the floating unit further comprises means for supplying air bubbles to the partly enclosed space, the partly enclosed space being configured to constitute an underwater air pocket filled with air bubbles upon supplying the air bubbles from the means for supplying the air bubbles when the floating unit floats in the water with the wall in the second position.

2 Claims, 5 Drawing Sheets

FLOATING UNIT

TECHNICAL FIELD

There is disclosed a floating unit with improved resistance to explosions, designed to transport and landing of soldiers, combat vehicles and other military equipment during military operations, in offshore zones and in inland waters.

BACKGROUND

Structural designs of floating units with improved resistance to explosions have not been described in professional literature so far.

SUMMARY

The floating unit has a hull which has a recess in a bottom in which a shield is placed. Further there are hydraulic cylinders, which are connected at one end to the hull and at the other end to the shield. A generator of air bubbles with a non return valve and a hose is mounted to the hull, wherein the other end of the hose is connected with the hole in the hull's bottom. In other words, the hose connects the air bubble generator with the hole in the hull.

There is disclosed a floating unit comprising: a hull having a recess in which a deployable wall is mounted, the wall being movable between a first and a second position; wherein in the first position the wall is enclosed within the hull in the recess; and in the second position the wall at least partly protrudes from the hull, thereby defining a partly enclosed space; and wherein the floating unit further comprises means for supplying air bubbles to the partly enclosed space, the partly enclosed space being configured to constitute an underwater air pocket filled with air bubbles upon supplying the air bubbles from the means for supplying the air bubbles when the floating unit floats in the water with the wall in the second position.

The means for supplying air bubbles may comprise a generator of air bubbles.

The wall can be activated by hydraulic cylinders.

BRIEF DESCRIPTION OF FIGURES

Further details and features of the present invention, its nature and various advantages will become more apparent from the following detailed description of the preferred embodiments shown in a drawing, in which.

DETAILED DESCRIPTION

Figure 1:
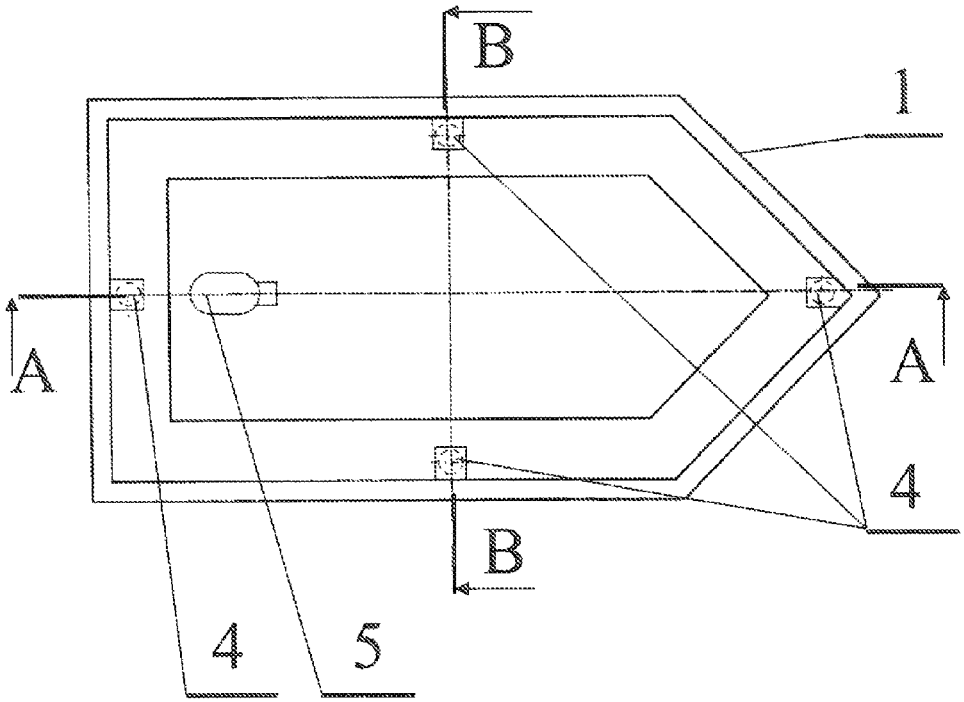
FIG. 1 shows a floating unit in a top view.
Figure 2:
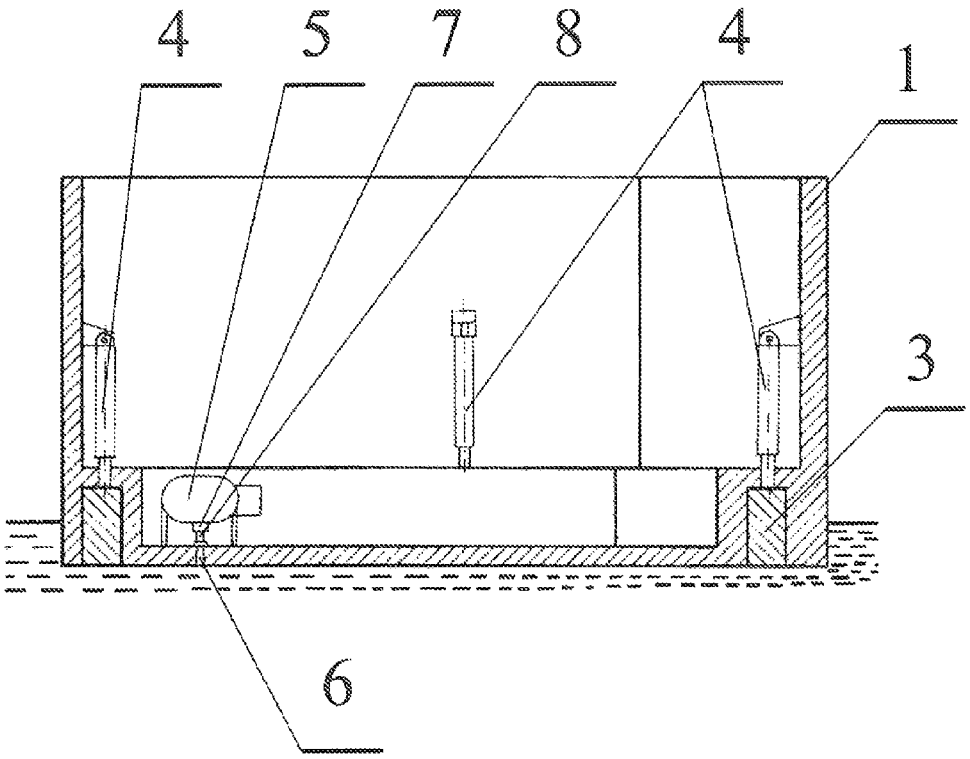
FIG. 2 shows the floating unit in a travelling configuration in the cross-section A-A of FIG. 1.
Figure 3:
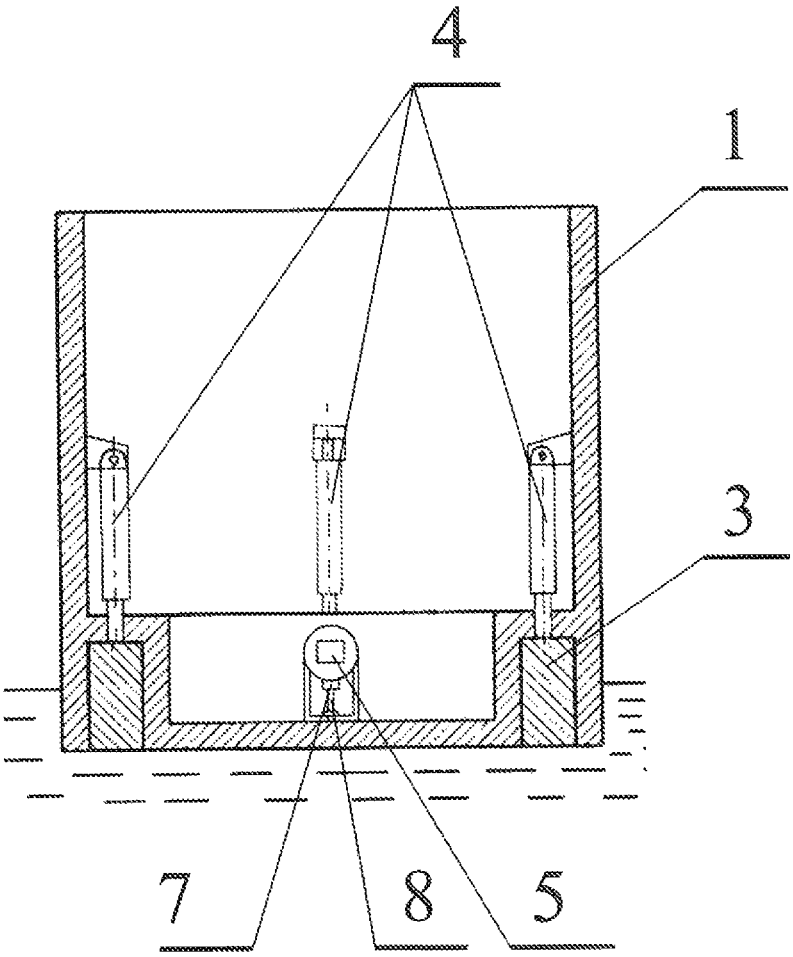
FIG. 3 shows the floating unit in a travelling configuration in the cross-section B-B of FIG. 1.
Figure 4:
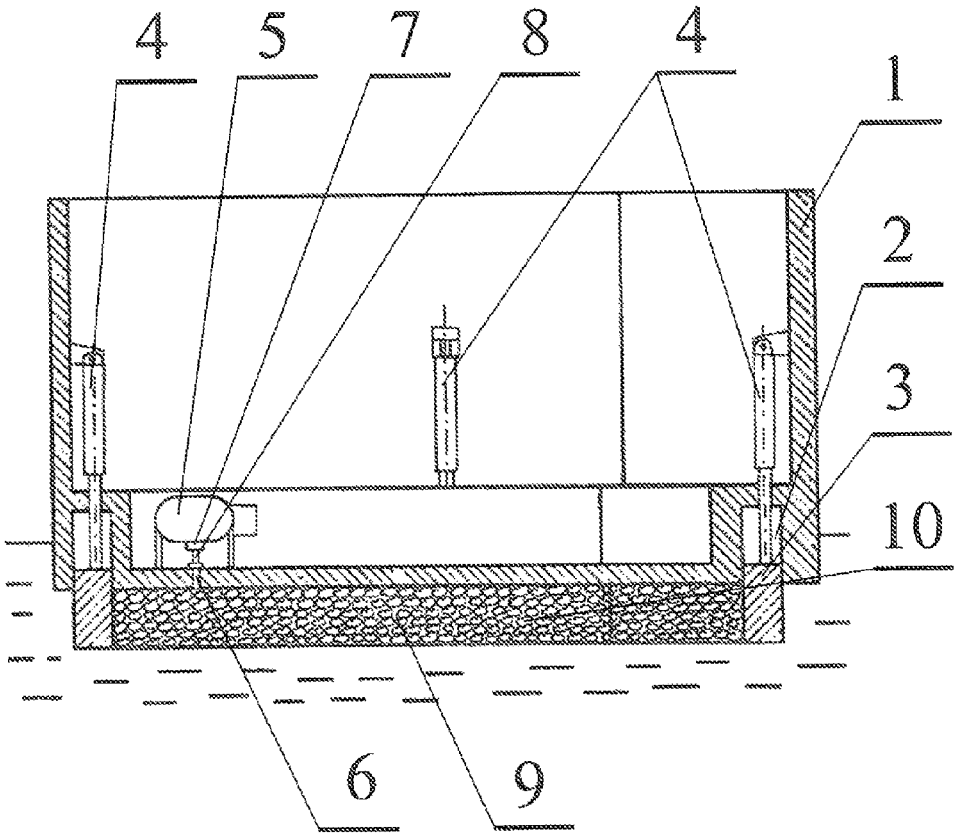
FIG. 4 shows a floating unit in an operating configuration in the cross-section A-A of FIG. 1.
Figure 5:
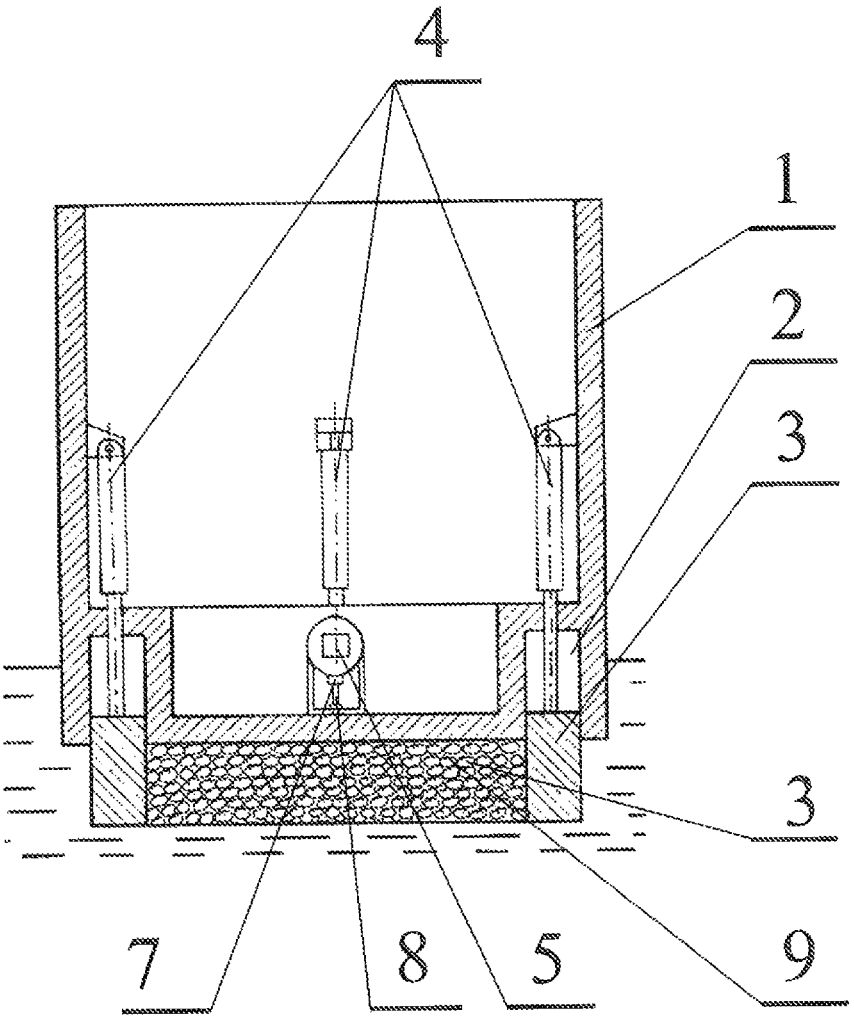
FIG. 5 shows the floating unit in the operating configuration in the cross-section B-B of FIG. 1.

The floating unit with improved resistance to explosions comprises a hull 1 with a recess 2 located in its bottom, in which a wall (shield) 3 is placed together with hydraulic cylinders 4. The hydraulic cylinders 4 are mounted to the hull at one end and to the wall 3 at the other end. The hull comprises a hole 6. The hole 6 is situated in the area of the hull 1 surrounded by the wall 3, as can be seen in the drawings. A generator of air bubbles 5 is connected to the hole 6 through a non-return valve 7 and a hose 8.

The operation of the floating unit with improved resistance to explosions consists in that when the floating unit approaches an offshore zone or when the need arises to cross inland water obstacles and when there is an increased risk of occurrence of mines, then the wall 3, by means of hydraulic cylinders 4, is moved from a first position, in which it is enclosed within the hull 1 in the recess 2, into a second, lower position, thus forming a partly enclosed space, e.g. a cavity with variable volume 9. Then, using the generator of air bubbles 5, said partly enclosed space is filled with air bubbles 10 which displace the water from the partly enclosed space. The air bubbles are provided through the non-return valve 7, the hose 8 and the hole 6, which form a passage for them. Effectively, the partly enclosed space constitutes an underwater air pocket, that is a space in which the air bubbles are trapped under the part of the submerged hull and that remain trapped under normal operating conditions.

The advantage of floating unit is that the cavity with the variable volume, created under the bottom of the floating unit and filled with air bubbles, works as a shock absorber damping the energy of the mine explosion.

Another advantage is that the shock wave moving from the water through air bubbles is weakened, what results in reducing the possible damage of the bottom of the hull. Consequently, the hypothetical damage done by hull's fragments will be lower.

The invention claimed is:

1. A floating unit comprising:

a hull having a recess in which a deployable wall is mounted, the deployable wall being movable between a first and a second position;

wherein in the first position the deployable wall is enclosed within the hull in the recess, and in the second position the deployable wall at least partly protrudes from the hull, thereby defining a partly enclosed space; and wherein the floating unit further comprises a generator of air bubbles connected to the partly enclosed space to fill the partly enclosed space with air bubbles when the floating unit floats in water with the deployable wall in the second position.

2. The floating unit according to claim 1, wherein deployment of the deployable wall may be activated by hydraulic cylinders.

* * * * *